US012421881B2

(12) United States Patent
Laigle et al.

(10) Patent No.: US 12,421,881 B2
(45) Date of Patent: Sep. 23, 2025

(54) SYSTEM AND METHOD FOR REDUCING INTERNAL COMBUSTION ENGINE EMISSIONS

(71) Applicant: SAUDI ARABIAN OIL COMPANY, Dhahran (SA)

(72) Inventors: Emmanuel Laigle, Courbevoie (FR); Christophe Chaillou, Rueil-Malmaison (FR); Caroline Norsic, Rueil-Malmaison (FR)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/324,764

(22) Filed: May 26, 2023

(65) Prior Publication Data

US 2024/0392711 A1 Nov. 28, 2024

(51) Int. Cl.
*F01N 3/031* (2006.01)
*F01N 9/00* (2006.01)

(52) U.S. Cl.
CPC ..... *F01N 3/031* (2013.01); *F01N 9/002* (2013.01); *F01N 2240/38* (2013.01); *F01N 2900/08* (2013.01)

(58) Field of Classification Search
CPC ..... B01D 2251/104; F01N 13/009; F01N 2240/38; F01N 2550/12; F01N 3/029; F01N 3/031; F01N 9/002; F01N 13/011; F01N 13/0093
See application file for complete search history.

(56) References Cited

U.S. PATENT DOCUMENTS

| | | | |
|---|---|---|---|
| 4,702,075 | A | 10/1987 | Jenny |
| 7,735,314 | B2 | 6/2010 | Lu et al. |
| 7,954,313 | B2 | 6/2011 | Hirata et al. |
| 8,161,732 | B2 | 4/2012 | Peters et al. |
| 9,021,792 | B2 | 5/2015 | Hosoya et al. |
| 9,482,125 | B2 | 11/2016 | Gonze et al. |
| 9,719,386 | B2 | 8/2017 | Fan et al. |
| 10,072,551 | B2 | 9/2018 | Uchiyama et al. |

(Continued)

FOREIGN PATENT DOCUMENTS

| | | | |
|---|---|---|---|
| CA | 2396281 | A1 | 12/2001 |
| CH | 665002 | A5 | 4/1988 |

(Continued)

OTHER PUBLICATIONS

Machine English Translation JP-2004084494-A (Year: 2004).*

(Continued)

*Primary Examiner* — Anthony Ayala Delgado
(74) *Attorney, Agent, or Firm* — Osha Bergman Watanabe & Burton LLP

(57) ABSTRACT

A system for reducing internal combustion engine emissions. The system includes an exhaust line for feeding an exhaust from an internal combustion engine to a catalytic converter and a particulate filter to produce a filtered exhaust. The system further includes a filter effluent line to feed this filtered exhaust to a tailpipe. The system further includes a bypass filtration system to receive the filtered exhaust and further filter the exhaust and return it to the filter effluent upstream of the tailpipe. The system further includes an ozone generator and a flow line to feed ozone to the bypass filtration system.

11 Claims, 3 Drawing Sheets

(56) References Cited

U.S. PATENT DOCUMENTS

| | | | | |
|---|---|---|---|---|
| 10,590,827 | B2 | 3/2020 | Ulrey et al. | |
| 11,661,872 | B2 | 5/2023 | Laigle et al. | |
| 2002/0175212 | A1 | 11/2002 | Hepburn et al. | |
| 2005/0241295 | A1 | 11/2005 | Breuer et al. | |
| 2006/0153761 | A1 | 7/2006 | Bandl-Konrad et al. | |
| 2008/0271439 | A1 | 11/2008 | Londos | |
| 2009/0235648 | A1 | 9/2009 | Kakinohana et al. | |
| 2009/0308060 | A1 | 12/2009 | Suzuki et al. | |
| 2010/0281856 | A1 | 11/2010 | Sakakibara et al. | |
| 2010/0287911 | A1 | 11/2010 | Katsuki et al. | |
| 2014/0366515 | A1 | 12/2014 | Kowalkowski et al. | |
| 2017/0102311 | A1 | 4/2017 | Zhang | |
| 2018/0238208 | A1* | 8/2018 | Saxman | F01N 1/165 |
| 2018/0334982 | A1* | 11/2018 | Sanborn | F02D 41/04 |
| 2018/0353905 | A1 | 12/2018 | Li et al. | |
| 2019/0017423 | A1 | 1/2019 | Martin et al. | |
| 2019/0383189 | A1 | 12/2019 | Dou et al. | |
| 2022/0220875 | A1 | 7/2022 | Laigle et al. | |
| 2022/0290599 | A1 | 9/2022 | Dou et al. | |

FOREIGN PATENT DOCUMENTS

| | | | | |
|---|---|---|---|---|
| CN | 108223060 | A | | 6/2018 |
| DE | 10241063 | A1 | | 3/2004 |
| DE | 102017102098 | A1 | | 8/2017 |
| EP | 1947303 | A1 | | 7/2008 |
| FR | 2859240 | A1 | | 3/2005 |
| JP | 2004084494 | A | * | 3/2004 |
| JP | 3600582 | B2 | | 12/2004 |
| JP | 2005330936 | A | | 12/2005 |
| JP | 2005538295 | A | | 12/2005 |
| JP | 2007132240 | A | | 5/2007 |
| JP | 2008002308 | A | * | 1/2008 |
| JP | 2008175136 | A | * | 7/2008 |
| JP | 4344565 | B2 | | 10/2009 |
| JP | 4449947 | B2 | | 4/2010 |
| JP | 201121456 | A | | 2/2011 |
| JP | 2018013048 | A | * | 1/2018 |
| KR | 100864600 | B1 | | 10/2008 |
| WO | 2006117993 | A2 | | 11/2006 |
| WO | 2006125928 | A1 | | 11/2006 |
| WO | 2006135073 | A1 | | 12/2006 |
| WO | 2008053105 | A1 | | 5/2008 |

OTHER PUBLICATIONS

Machine English Translation JP-2008175136-A (Year: 2008).*
Machine English Translation JP-2008002308-A (Year: 2008).*
https://web.archive.org/web/20201130134514/https://www.sciencedirect.com/science/article/pii/S2214157X18304301 (Year: 2020).*
JP 2018013048 English Machine Translation (Year: 2018).*
Office Action issued in corresponding U.S. Appl. No. 17/144,535; dated Jul. 23, 2021 (18 pages).
Office Action issued in corresponding U.S. Appl. No. 18/489,944; dated Feb. 29, 2024 (19 pages).
Yusuf, A.A. et al., "Effect of cold start emissions from gasoline-fueled engines of lightduty vehicles at low and high ambient temperatures: Recent trends," Case Studies in Thermal Engineering, 14, 100417, pp. 1-10, Feb. 20, 2019 (10 pages).
International Search Report issued for corresponding international patent application No. PCT/US2024/030401, mailed Sep. 3, 2024 (6 pages).
Written Opinion issued for corresponding international patent application No. PCT/US2024/030401, mailed Sep. 3, 2024 (9 pages).

* cited by examiner

SYSTEM AND METHOD FOR REDUCING INTERNAL COMBUSTION ENGINE EMISSIONS

BACKGROUND

Soot particles emitted to the atmosphere are a significant pollutant produced by some internal combustion engines (ICEs), such as diesel, gasoline, or natural gas engines. In internal combustion engines (ICEs), most of the soot emissions at the engine out and tailpipe are emitted in cold-start conditions, when the coolant temperature is too low to allow a good evaporation of the fuel inside the combustion chamber. Cold start conditions, that is conditions where the engine is being started below its normal operating temperature, may produce much of the cumulative particulate matter (PM) produced during operation.

FIG. 1 is a depiction of a system 100 of an exhaust gas configuration as seen in prior art. In system 100, exhaust gas line 103 connects an engine 101 with a catalytic converter 105. The outlet of the catalytic converter 105 feeds into the particulate filter 107, from which the exhaust gas flows to tailpipe 109 and exits the system to the atmosphere. Exhaust flows from the engine 101 contacting catalyst within catalytic converter 105 to reduce the amount of gaseous pollutants, and into the particulate filter 107, which stores solid pollutants.

At startup, the particulate filter 107 is initially empty, and the filtration efficiency is only partial at cold start and filtration efficiency increases with continued engine operations. Accordingly, there is a need for reducing particulate emissions during cold start conditions.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system for reducing internal combustion engine emissions including an exhaust line for feeding an exhaust from an internal combustion engine to a catalytic converter and a particulate filter to produce a filtered exhaust. The filtered effluent line feeds the filtered exhaust to a tailpipe. A bypass filtration system may receive the filtered exhaust and further filter the exhaust and return it to the filter effluent upstream of the tailpipe, The system includes an ozone generator and a flow line to feed ozone to the bypass filtration system.

In another aspect, embodiments disclosed herein relate to a method for reducing emissions from an internal combustion engine by diverting an exhaust during cold start conditions of an internal combustion engine into a bypass filtration system to filter the exhaust and feed the filtered exhaust to the tailpipe. During normal operations, the method feeds the exhaust from the engine to the tailpipe without passing the exhaust through the bypass filtration system.

Other aspects and advantages of the claimed subject matter will be apparent from the following description and the appended claims.

DETAILED DESCRIPTION

Figure 1:
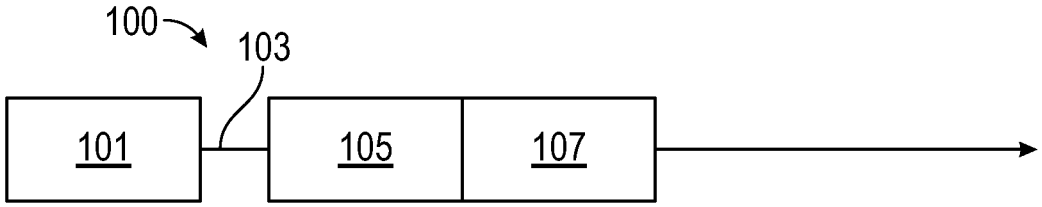
FIG. 1 (Prior Art)
FIG. 1 is a schematic depiction of a system 100 of an exhaust gas configuration as seen in prior art.

Embodiments herein are directed to systems and processes to reduce cold start particulate emissions of internal combustion engines. To reduce soot emissions in cold start conditions, embodiments herein include a bypass particulate filter on a main exhaust line downstream of the catalytic converter (CAT) and the particulate filter (PF). The bypass particulate filter is fluidly connected to the main exhaust line with a bypass exhaust line, and inlet and outlet valves to the main exhaust line are provided to allow bypassing the main line to force the gas to flow through the bypass particulate filter when required, such as during cold start.

Particulate filters require regeneration to remove accumulated particulate matter from the filter that may block flow of the exhaust and reduce effectiveness of the particulate filter. Regeneration may be accomplished by oxidation of the particulate matter, such as soot particles. In accordance with one or more embodiments, the bypass particulate filter may be close to the tailpipe, meaning that the opportunities to burn particulate matter (PM) may be reduced when compared to the particulate filter. To oxidize additional particulate matter during cold start, to regenerate the bypass particulate filter, or both, ozone may be injected into the bypass line upstream of the bypass particulate filter. Ozone may be provided by means of an ozone generator, such as a corona discharge.

In accordance with one or more embodiments, the particulate filter, the bypass particulate filter, or both may be a wall flow type particulate filter, where the filter is in a honeycomb shape with alternately blocked passageways. The exhaust enters the blocked passageways and may pass through a porous wall into an unblocked passageway before it continues to the outlet of the filter. Particulate matter is trapped in the blocked passageway by the pore size and the previously trapped particulate matter. The walls may also include one or more catalysts to enhance one or more chemical reactions, such as for removal of $NO_x$ by conversion to $N_2$.

The bypass particulate filter may have a lower porosity and reduced mean pore size than the particulate filter. In accordance with one or more embodiments, the bypass particulate filter may be designed to have a higher backpressure than the particulate filter. Furthermore, the bypass particulate filter may be designed to have better filtration efficiency when empty even if it has a higher backpressure than the particulate filter. For example, the mean pore size of the bypass particulate filter may be in a range of about about 1 μm to about 20 μm. The porosity may be in a range of about 30% to about 60%. The wall thickness of the bypass particulate filter may be in a range of about 0.005 inches to about 0.02 inches. Operation of the bypass during startup and further away from the engine than the particulate filter may mean that the operating temperature of the bypass particulate filter is reduced when compared to the particulate filter design conditions.

Figure 2:
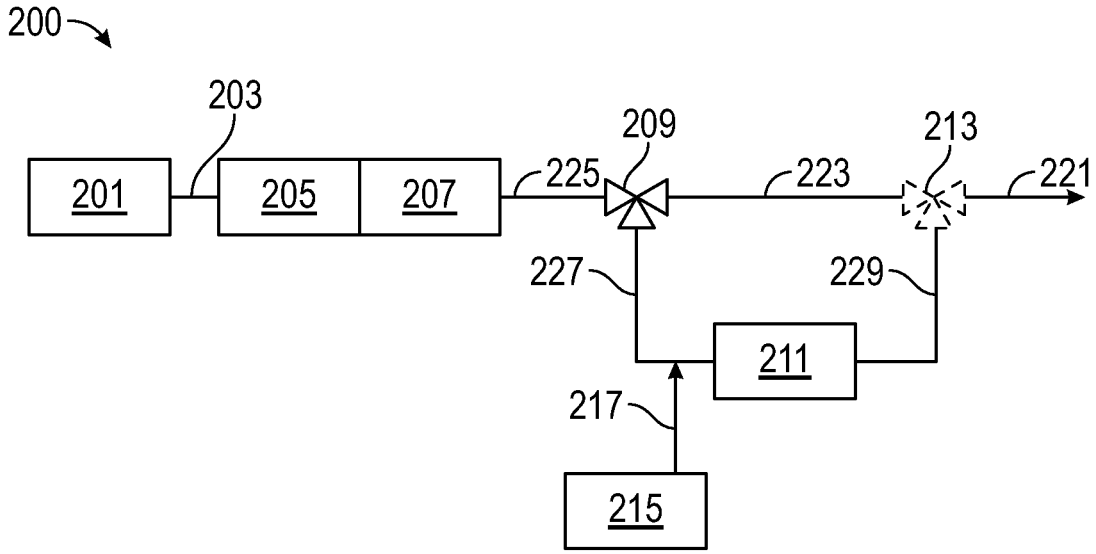
FIG. 2 is a schematic depiction of a system 200 of an exhaust gas configuration in accordance with one or more embodiments.

FIG. 2 is a depiction of a system 200 of an exhaust gas configuration in accordance with one or more embodiments. In system 200, exhaust gas line 203 connects an engine 201 with a catalytic converter 205. The catalytic converter 205 effluent feeds into the particulate filter 207. The system then provides two alternative pathways for the exhaust to continue to tailpipe 221. During normal operations, the filtered exhaust may flow directly from the particulate filter 207 to tailpipe 221 via main exhaust lines 223, 225. During cold start conditions, for example, the filtered exhaust may be diverted into a bypass line 227 for processing in the bypass filter 211. The effluent from the bypass filter may then be fed via flow line 229 back into the main exhaust line 223/tailpipe 221.

The bypass exhaust manifold connecting the bypass filter 211 to the main exhaust lines 223, 225 may include a bypass inlet valve 209 and a bypass outlet valve 213. The bypass inlet and outlet valves may be three-way valves or may include multiple valves for providing the same functionality.

The internal combustion engine 201 produces a primary exhaust by combusting a fuel. Primary exhaust flows from the engine 201 into catalytic converter 205, where the primary exhaust undergoes catalytic conversion, reducing the amount of gaseous pollutants, before flowing into the particulate filter 207 to produce exhaust from the internal combustion engine. When additional filtration is needed, such as during cold start, the bypass system is operated, meaning that the filtered exhaust from the particulate filter 207 is allowed to flow through the bypass exhaust manifold from the bypass inlet valve 209, into the bypass particulate filter 211, and out through the bypass outlet valve 213 before exiting tailpipe 221.

To oxidize additional particulate matter during cold start, to regenerate the bypass particulate filter, or both, ozone may be injected into the bypass line upstream of the bypass particulate filter. As illustrated in FIG. 2, an ozone generator 215 may be provided to generate ozone, which may be fed via line 217 into bypass line 227 and bypass particulate filter 211.

Particulate matter may include dry soot (carbon, C), soluble organic fractions (SOFs), and hydrocarbon compounds (HCs). In accordance with one or more embodiments, $O_3$ generated is injected upstream of the bypass particulate filter to convert these components to less harmful substances. The ozone generator may be a corona discharge ozone generator, for example, although other methods to generate ozone known in the art may also be used.

In one or more embodiments, ozone may be injected into the bypass filtration system during cold start conditions, mixing with the exhaust upstream of the bypass particulate filter to convert additional particulate matter in the engine exhaust. In other embodiments, the ozone may be injected into the bypass filtration after startup to regenerate the bypass particulate filter, reacting with the soot captured by the bypass particulate filter. In yet other embodiments, ozone may be injected during cold start and for a period of time after normal operations are obtained, to both convert a portion of the soot during cold start and to oxidize soot captured by the bypass particulate filter so as to regenerate the bypass particulate filter. Ozone injection may be carried out when the bypass is operating to have better oxidation of the particulate matter. However, ozone injection may also be carried out when the bypass is not operating to remove excess PM that was not oxidized during bypass operation. Subsequently, the captured PM, but also particles in the gas phase, are oxidized to gaseous $CO_x(=CO+CO_2)$ by means of oxygen radicals (O), which are mainly produced by the decomposition of the ozone. The oxygen radicals and hydroxyl radicals (OH) contribute to the oxidation of the soot, and the oxygen radicals particularly play an important role in the reactions.

The generated ozone may not be sufficient to oxidize all the particles in the gas phase during the cold start and a large part of these are captured by the bypass particulate filter. If the walls of the bypass particulate filter are too heavily loaded with particulate matter, ozone can be sent to the bypass particulate filter even when the bypass inlet valve is closed. Regeneration may be less efficient when the bypass is inactive due to the absence of $NO_2$, but soot may be sufficiently oxidized to limit the backpressure of the bypass particulate filter.

Ozone injection may be carried out at any point during operation of the bypass, after operation of the bypass, or both. For example, ozone injection may occur both during and after operation of the bypass. Furthermore, in accordance with one or more embodiments, ozone gas may be produced in the ozone generator and sent through the ozone generator outlet into the bypass particulate filter while the exhaust is being fed into the bypass particulate filter. Regeneration may also occur after the exhaust is fed into the bypass particulate filter without the internal combustion engine shutting down after feeding the exhaust to the bypass particulate filter. In addition, regeneration may occur after the internal combustion engine has shut down and started again after feeding the exhaust into the bypass particulate filter. In other embodiments, ozone gas may continuously be sent into the bypass particulate filter both during operation of the bypass particulate filter and continuing immediately after operation of the bypass particulate filter has ceased. Ozone gas may also be sent from the ozone generator into the bypass particulate filter for regeneration during any subsequent operation of the ICE, with or without operation of the bypass particulate filter.

Some of the chemical reactions that occur during regeneration may include:

$$O_3 \rightarrow O_2 + O \quad (1)$$

$$NO + O \rightarrow NO_2 \quad (2)$$

$$H_2O + O \rightarrow 2OH \quad (3)$$

$$C + 2O_3 \rightarrow CO_2 + 2O_2 \quad (4)$$

$$C + 2O \rightarrow CO_2 \quad (5)$$

$$C + O_3 \rightarrow CO + O_2 \quad (6)$$

$$C + O \rightarrow CO \quad (7)$$

$$C + 2OH \rightarrow CO + H_2O \quad (8)$$

$$SOF + xO(\text{or } O_3) \rightarrow yCO_2 + zH_2O \quad (9)$$

$$HC + xO(\text{or } O_3) \rightarrow yCO_2 + zH_2O \quad (10)$$

$$NO_2 + C \rightarrow NO + CO \quad (11)$$

$$2NO_2 + 2C \rightarrow N_2 + 2CO_2 \quad (12)$$

At cold start, the coolant temperature is too low to allow for sufficient evaporation of the fuel inside the combustion chamber to prevent soot formation. In one or more embodiments, the bypass inlet valve may open to allow exhaust to travel to the bypass particulate filter while the temperature of the engine coolant is in a range of ambient temperature (such as about 15° C.) to 125° C., when the internal combustion engine has been operating for less than any of 30 seconds, 1 minute, 3 minutes, 5 minutes, 7 minutes, 10 minutes, or 15 minutes, depending on the coolant temperature, or both. The exhaust can pass through the bypass particulate filter for at least 30 seconds. The bypass particulate filter may be active when the temperature of the exhaust through the first particulate filter is below 400° C. or above 600° C. with a presence of at least 1% oxygen.

The ozone generator may send ozone through the bypass particulate filter either when the bypass is being utilized during cold start, after the bypass inlet valve has been shut and the bypass particulate filter is being regenerated and not filtering exhaust, or both. The bypass outlet valve, when present in the system, may be open during regeneration to allow waste gases to leave the bypass line.

In accordance with one or more embodiments, the ozone generator may inject the ozone while the exhaust is being fed to the bypass particulate filter when the temperature is in a range of about −40° C. to about 350° C., and in one or more embodiments, the temperature may be in a range with a minimum value of any of −40° C., −25° C., −10° C., 0° C., 10° C., 20° C., 50° C., 100° C., 150° C., 200° C., 220° C., or 250° C. and a maximum value of any of 150° C., 200° C., 220° C., 250° C., 300° C., 320° C., or 350° C., with any maximum value being combinable with any numerically compatible minimum value. After the exhaust is fed to the bypass particulate filter, and while the exhaust is not being filtered by the bypass particulate filter, the ozone generator may send ozone to the bypass particulate filter when the temperature of the bypass particulate filter is in a range of −40° C. to 350° C., and in one or more embodiments, the temperature may be in a range with a minimum value of any of −40° C., 0° C., 50° C., 100° C., 150° C., 200° C., 220° C., or 250° C. and a maximum value of any of 150° C., 200° C., 220° C., 250° C., 300° C., 320° C., or 350° C., with any maximum value being combinable with any numerically compatible minimum value. Soot regeneration kinetics increase with temperature and produces mainly CO and $CO_2$, with the $CO_2$ selectivity being between 70% and 90%, increasing with a decrease in temperature.

The necessity for regeneration may be detected through means known to those skilled in the art. For example, the backpressure across the bypass particulate filter may be used to determine if regeneration is required.

Embodiments herein further provide a control system for controlling operations of the bypass filtration system. The control system may be configured to control operations of the bypass inlet valve system, the ozone generator, or both. For example, during cold start conditions, the control system may divert a flow of the filtered exhaust into the bypass filtration system by operating the bypass inlet valve system. After cold start and during normal engine operations, the control system may operate the bypass inlet valve system to permit flow from the particulate filter to the tailpipe without passing the filtered exhaust through the bypass filtration system.

The control system may also be configured to operate the ozone generator during cold start conditions, normal engine operations, or both. For example, the control system may be configured to operate the ozone generator for a period of time after normal engine operating conditions are achieved.

The control system may measure and monitor a temperature of an engine coolant and determine when cold start is occurring and when normal operating conditions are achieved. The control system may then the control system may control the position of the bypass inlet valve based on the measured engine coolant temperature.

EXAMPLES

Figure 3A:
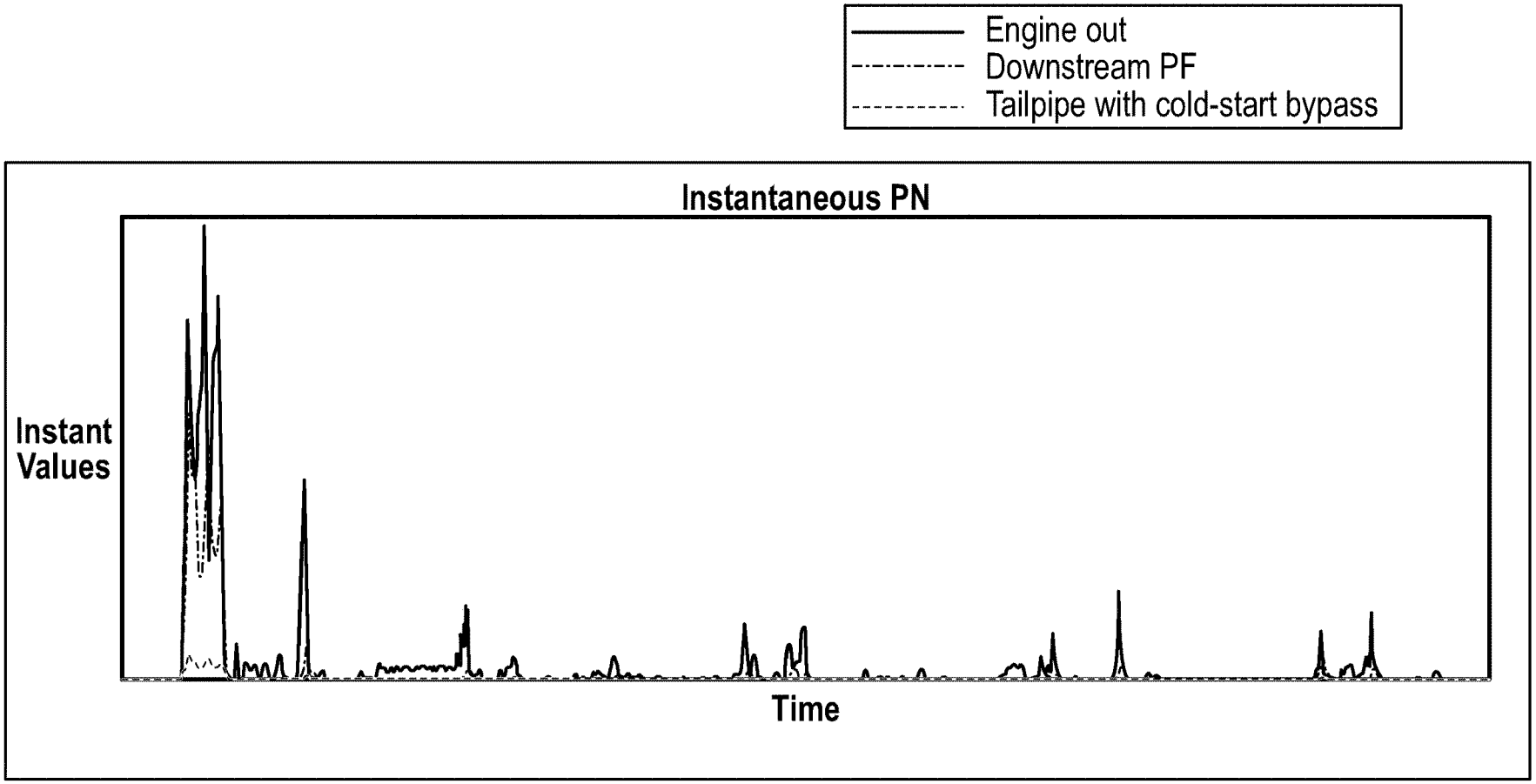
FIG. 3A is a plot of instant particulate matter as a function of time obtained for an example embodiment.
Figure 3B:
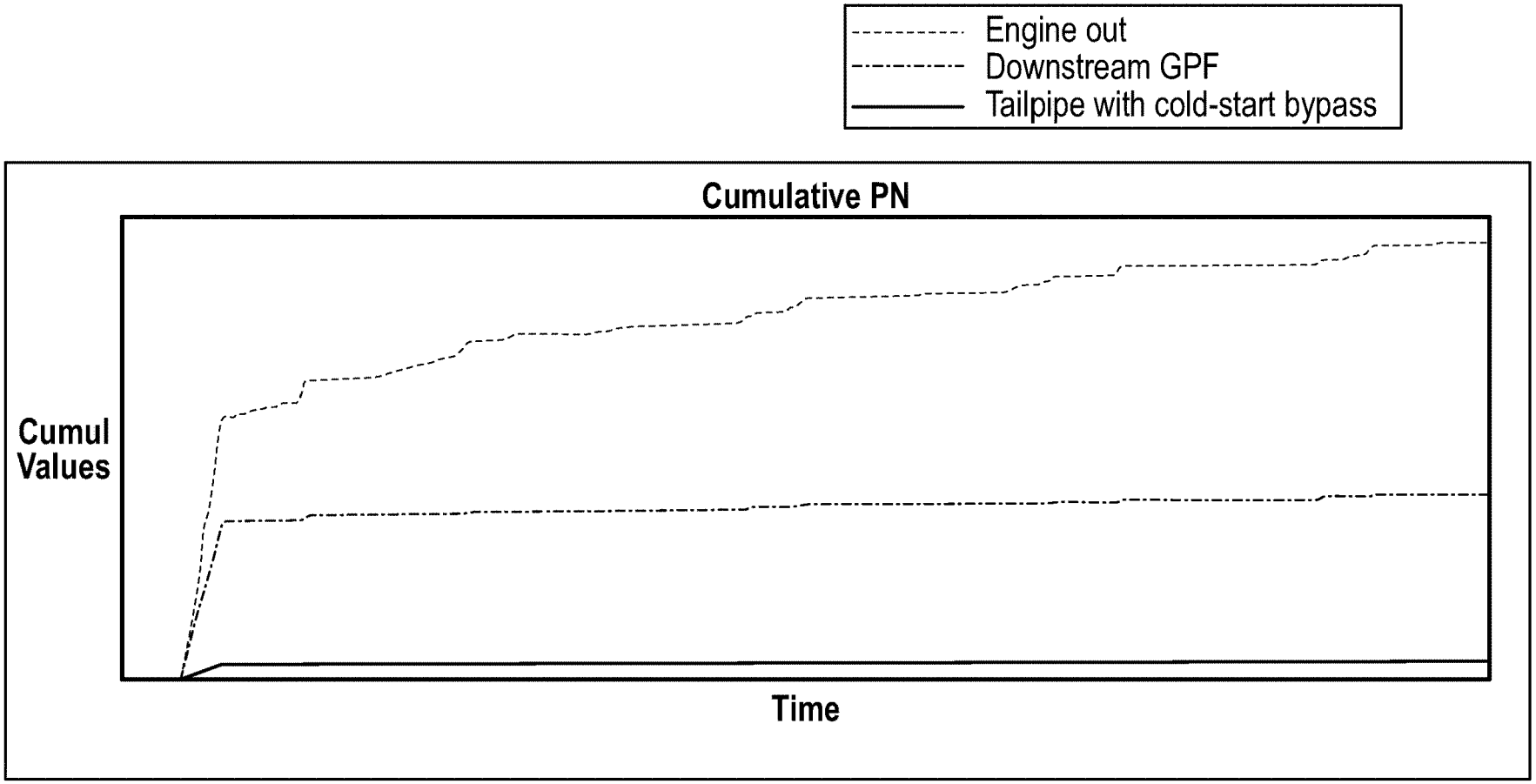
FIG. 3B is a plot of cumulative particulate matter as a function of time obtained for an example embodiment.

Plots of instant and cumulative particulate number as a function of time obtained for an example embodiment of a bypass particulate filter during cold start are shown in FIGS. 3A and 3B respectively. As seen in FIGS. 3A and 3B, at the engine output, the amount of particulate was greatest at cold start. The particulate filter was able to significantly reduce the particulate number, but a large amount of particulate was still released downstream of the particulate filter. A significant reduction in particulate number, both instantaneous particulate released as well as cumulative particulate released was seen with the addition of the bypass particulate filter. The experiment used the Worldwide harmonized Light vehicles Test Cycle (WLTC) with an EB2ADTS engine (with three 1.2 L cylinders) with cordierite gasoline particulate filters (GPF).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A system for reducing internal combustion engine emissions, comprising:

an exhaust line for feeding an exhaust from an internal combustion engine to a catalytic converter and a particulate filter producing a filtered exhaust;

a filter effluent line for feeding the filtered exhaust to a tailpipe;

a bypass filtration system comprising a bypass inlet configured for receiving filtered exhaust from the filter effluent line, a bypass filter for further filtering the filtered exhaust to produce a bypass filtered stream, and a bypass filter effluent line connected to the filter effluent line, the bypass filter effluent line configured to return the bypass filtered stream to the filter effluent line upstream of the tailpipe;

an ozone generator configured to generate ozone;

a flow line for feeding the ozone to the bypass filtration system downstream of the bypass inlet and upstream of the bypass filter when the bypass filter has a temperature of −40 to 220° C.; and a control system configured to control an operation of a bypass inlet valve system, the ozone generator, or both, wherein the bypass inlet valve system is configured for diverting the filtered exhaust from the filter effluent line into the bypass filtration system, and wherein:

a bypass filter porosity is smaller than a particulate filter porosity, and a bypass filter pore size is smaller than a particulate filter pore size.

2. The system of claim 1, further comprising a bypass outlet valve disposed downstream of the bypass filter and upstream of the tailpipe.

3. The system of claim 1, wherein the control system is configured to:

a. Operate the bypass inlet valve system to divert a flow of the filtered exhaust into the bypass filtration system when the bypass filter has a temperature of −40 to 220° C.; and b. Operate the bypass inlet valve system to permit flow from the particulate filter to the tailpipe without passing the filtered exhaust through the bypass filtration system after cold start and during normal engine operations.

4. The system of claim 1, wherein the control system is configured to:

a. Operate the ozone generator when the bypass filter has a temperature of −40 to 220° C.;

b. Operate the ozone generator during normal engine operations; or c. Both (a) and (b).

5. The system of claim 4, wherein the control system is configured to operate the ozone generator for a period of time after normal engine operating conditions are achieved.

6. A method for reducing emissions from an internal combustion engine, comprising:

feeding a primary exhaust from the internal combustion engine to a catalytic converter and a particulate filter, thereby producing a filtered exhaust;

feeding the filtered exhaust to a filter effluent line connecting the particulate filter to a tailpipe;

during cold start conditions, diverting the filtered exhaust from the filter effluent line to a bypass filter, further filtering the filtered exhaust in the bypass filter to produce a bypass filtered stream, feeding the bypass filtered stream to the filter effluent line using a bypass filter effluent line connecting the bypass filter to the filter effluent line upstream of the tailpipe, and feeding the bypass filtered stream from the filter effluent line to the tailpipe;

during normal operating conditions, feeding the filtered exhaust from the filter effluent line to the tailpipe without passing the filtered exhaust through the bypass filter;

generating and mixing ozone with the filtered exhaust upstream of the bypass filter when the bypass filter has a temperature of −40 to 220° C., and regenerating the bypass filter by generating ozone and passing the ozone through the bypass filter during normal operating conditions.

7. The method of claim 6, further comprising combusting a fuel in the internal combustion engine to produce the primary exhaust.

8. The method of claim 6, further comprising measuring a temperature of an engine coolant, and determining, via a control system, when normal operating conditions are achieved.

9. The method of claim 8, wherein the diverting further comprises controlling, via the control system, a position of a bypass inlet valve system based on a measured temperature of the engine coolant.

10. A system for reducing internal combustion engine emissions, comprising:

an exhaust line for feeding an exhaust from an internal combustion engine to a catalytic converter and a particulate filter producing a filtered exhaust;

a filter effluent line for feeding the filtered exhaust to a tailpipe;

a bypass filtration system comprising a bypass inlet configured for receiving filtered exhaust from the filter effluent line, a bypass filter for further filtering the filtered exhaust to produce a bypass filtered stream, and a bypass filter effluent line connected to the filter effluent line, the bypass filter effluent line configured to return the bypass filtered stream to the filter effluent line upstream of the tailpipe;

an ozone generator configured to generate ozone;

a flow line for feeding the ozone to the bypass filtration system downstream of the bypass inlet and upstream of the bypass filter when the bypass filter has a temperature of −40 to 220° C. and normal operating conditions;

a control system configured to control an operation of a bypass inlet valve system, the ozone generator, or both;

wherein the control system is configured to operate the bypass inlet valve system to divert a flow of the filtered exhaust into the bypass filtration system when the bypass filter has a temperature of −40 to 220° C. and operate the bypass inlet valve system to permit flow from the particulate filter to the tailpipe without passing the filtered exhaust through the bypass filtration system after cold start and during normal engine operations;

wherein the control system is configured to operate the ozone generator when the bypass filter has a temperature of −40 to 220° C., during normal operations, or both, and wherein:

a bypass filter porosity is smaller than a particulate filter porosity, and a bypass filter pore size is smaller than a particulate filter pore size.

11. The method of claim 6, wherein:

a bypass filter porosity is smaller than a particulate filter porosity, and a bypass filter pore size is smaller than a particulate filter pore size.

* * * * *